US009457989B2

(12) United States Patent
Meierhans et al.

(10) Patent No.: US 9,457,989 B2
(45) Date of Patent: Oct. 4, 2016

(54) BRAKING DEVICE WITH ACTUATING DEVICE

(71) Applicants: Daniel Meierhans, Lucerne (CH); Faruk Osmanbasic, Cham (CH); Marcus Junig, Emmenbrucke (CH); Michael Geisshusler, Lucerne (CH); Nicolas Gremaud, Richterswil (CH); Josef A. Muff, Hildisrieden (CH)

(72) Inventors: Daniel Meierhans, Lucerne (CH); Faruk Osmanbasic, Cham (CH); Marcus Junig, Emmenbrucke (CH); Michael Geisshusler, Lucerne (CH); Nicolas Gremaud, Richterswil (CH); Josef A. Muff, Hildisrieden (CH)

(73) Assignee: Inventio AG, Hergiswil (CH)

( * ) Notice: Subject to any disclaimer, the term of this patent is extended or adjusted under 35 U.S.C. 154(b) by 591 days.

(21) Appl. No.: 13/625,385

(22) Filed: Sep. 24, 2012

(65) Prior Publication Data

US 2013/0081908 A1 Apr. 4, 2013

(30) Foreign Application Priority Data

Sep. 30, 2011 (EP) ..... 11183388

(51) Int. Cl.
*B66B 5/20* (2006.01)
*B66B 5/18* (2006.01)

(52) U.S. Cl.
CPC .. *B66B 5/18* (2013.01); *B66B 5/20* (2013.01)

(58) Field of Classification Search
CPC ..... B66B 5/18; B66B 5/22
USPC ..... 187/368, 359
See application file for complete search history.

(56) References Cited

U.S. PATENT DOCUMENTS

| | | | | |
|---|---|---|---|---|
| 3,706,361 | A * | 12/1972 | Paulssen et al. | 188/189 |
| 3,783,978 | A * | 1/1974 | Hamilton | 187/278 |
| 5,096,020 | A * | 3/1992 | Korhonen | 187/376 |
| 5,199,532 | A * | 4/1993 | Suganuma et al. | 187/359 |
| 5,234,079 | A * | 8/1993 | Nomura | 187/250 |
| 5,363,942 | A * | 11/1994 | Osada | 187/376 |
| 5,377,786 | A * | 1/1995 | Nakagawa | 187/287 |
| 5,819,879 | A * | 10/1998 | Lang et al. | 187/376 |
| 6,173,813 | B1 * | 1/2001 | Rebillard et al. | 187/287 |
| 6,176,350 | B1 * | 1/2001 | Schlosser | 187/368 |
| 6,318,505 | B1 * | 11/2001 | De Angelis | 187/292 |
| 6,425,462 | B1 | 7/2002 | Tran et al. | |
| 6,902,369 | B2 * | 6/2005 | Tanigawa | 414/674 |
| 7,080,717 | B2 * | 7/2006 | Ito | 187/350 |
| 7,134,529 | B2 * | 11/2006 | Maury | 187/359 |
| 7,267,201 | B2 * | 9/2007 | Ito | 187/372 |
| 7,398,863 | B2 * | 7/2008 | Liebetrau et al. | 187/367 |

(Continued)

FOREIGN PATENT DOCUMENTS

EP 2194014 * 9/2007

*Primary Examiner* — Michael Riegelman
(74) *Attorney, Agent, or Firm* — Fraser Clemens Martin & Miller LLC; William J. Clemens

(57) ABSTRACT

An elevator cage is movable along at least two guide rails and the elevator cage is equipped with a braking system. The elevator braking device has a brake housing and a force store. The brake housing is mounted to be displaceable between a first position and a second position. The force store acts on the brake housing and pushes the brake housing in the direction of a second position. In addition, the elevator braking device includes an actuator which can act on the brake housing and keep the brake housing in a first position. The actuator in its first setting can hold the brake housing in the first position against the force of the force store. In a second setting the actuator enables pushing of the brake housing into the second position. A brake element is thereby brought into contact with the brake rail.

19 Claims, 8 Drawing Sheets

(56) References Cited

U.S. PATENT DOCUMENTS

| | | | | |
|---|---|---|---|---|
| 7,575,099 | B2 * | 8/2009 | Oh et al. | 187/286 |
| 7,650,969 | B2 * | 1/2010 | Monzon et al. | 187/300 |
| 7,849,972 | B2 * | 12/2010 | Higashinaka | 187/351 |
| 8,186,483 | B2 * | 5/2012 | Sirigu et al. | 187/366 |
| 2004/0262091 | A1 * | 12/2004 | Ito | 187/372 |
| 2005/0126862 | A1 * | 6/2005 | Ito | 187/350 |
| 2006/0090969 | A1 * | 5/2006 | Eckenstein et al. | 188/65.1 |
| 2008/0128218 | A1 * | 6/2008 | Gremaud et al. | 187/250 |
| 2010/0038184 | A1 * | 2/2010 | Emmerich et al. | 187/288 |
| 2011/0100761 | A1 * | 5/2011 | Dudde et al. | 187/359 |
| 2012/0152658 | A1 * | 6/2012 | Osmanbasic | 187/288 |
| 2012/0152659 | A1 * | 6/2012 | Husmann et al. | 187/373 |
| 2012/0152663 | A1 * | 6/2012 | Legeret et al. | 187/404 |
| 2013/0081908 | A1 * | 4/2013 | Meierhans et al. | 187/359 |
| 2013/0105250 | A1 * | 5/2013 | Meierhans et al. | 187/350 |
| 2013/0133984 | A1 * | 5/2013 | Osmanbasic et al. | 187/306 |
| 2013/0175120 | A1 * | 7/2013 | Bray et al. | 187/359 |
| 2013/0213750 | A1 * | 8/2013 | Meierhans et al. | 188/261 |
| 2013/0248298 | A1 * | 9/2013 | Osmanbasic et al. | 187/359 |
| 2014/0216857 | A1 * | 8/2014 | Mizuno et al. | 187/359 |

* cited by examiner

BRAKING DEVICE WITH ACTUATING DEVICE

CROSS-REFERENCE TO RELATED APPLICATION

This application claims priority to European Patent Application No. 11183388.5, filed Sep. 30, 2011, which is incorporated herein by reference.

FIELD

The disclosure relates to an elevator braking device.

BACKGROUND

The elevator installation is installed in a building. It consists essentially of a cage which is connected by way of support means with a counterweight or with a second cage. The cage is moved along substantially vertical guide rails by means of a drive, which selectably acts on the support means or directly on the cage or the counterweight. The elevator installation is used in order to convey persons and goods within a building over individual or several stories. The elevator installation includes devices in order to secure the elevator cage in the case of failure of the drive or the support means. For that purpose use is usually made of braking devices which can brake the elevator cage on the guide rails when required.

SUMMARY

In at least some embodiments, an elevator braking device is proposed which can retard and hold an elevator cage in co-operation with a brake rail when required. Possibly, this elevator braking device is arranged on a travelling body of the elevator, for example the elevator cage or if need be also on the counterweight, and it can co-operate with guide rails which for this purpose comprise the brake rails. The brake rails can also be used multi-functionally for guidance of the travelling body. In analogous manner the elevator braking device can also be arranged in the region of the drive and the brake rail can be a brake disc or also a brake cable.

The elevator braking device comprises at least one brake housing. The brake housing includes parts which are suitable for being brought into engagement with brake rail for the purpose of braking.

Possibly, the elevator braking device comprises for that purpose at least one brake element which is constructed to be self-energizing, for example with a wedge or an eccentric or another form of amplifying curve. This brake element is possibly incorporated in the brake housing. Self-energizing means that the brake element, after it has been brought by an initial force up to the brake rail, automatically moves into a braking setting by a relative movement between elevator braking device and brake rail. An initial force of that kind is provided by a force store which is constructed to press the brake element, when required, against the brake surface in that the brake housing is urged in vertical direction into a second position, possibly an upper position.

The elevator braking device further comprises an actuator which can similarly act on the brake housing and which is constructed in order to hold the brake housing in a first position, possibly a lower position. This first position corresponds in the starting location with an operating position of the elevator installation. In this operating position the elevator braking device is not disposed in braking engagement and the elevator installation or the travelling bodies thereof can be moved in accordance with operation. The actuator can thus in a first setting hold the brake housing in the first position against the force of the force store. In a second setting the actuator enables pushing of the brake housing into the second position. Through displacement of the brake housing to the second position, braking parts of the elevator braking device such as, for example, the said brake elements are now brought into engagement with the brake rail, whereby braking is initiated and performed.

The brake housing is for that purpose mounted to be displaceable vertically, or in a longitudinal direction parallel to a braking direction, between the first, possibly lower, position and the second, possibly upper position. The braking direction in that case results from a travel direction of the travelling body. Thus, on the one hand when the actuator holds the brake housing in the first position an unbraked movement of the travelling body is made possible. When required, the actuator releases the brake housing, whereby the force store can bring the brake housing into the second position and as a result the braking can be initiated.

In further embodiments the elevator braking device further comprises a support which can be attached to the travelling body of the elevator installation or integrated therein. The support includes a vertical guide which enables substantially vertical displacement of the brake housing between the first position and the second position. Thus, an economic modular solution can be provided, which can be installed not only in existing elevators, but also in new elevator concepts.

In further embodiments the force store of the elevator braking device comprises a compression spring which acts on the brake housing and which is possibly arranged between the support and the brake housing. Pneumatic, hydraulic or, for example in the case of an arrangement at a stationary body, for example at the drive, also weight-based force stores obviously also come into question.

In further embodiments the brake housing comprises the brake element, wherein this brake element is mounted in the brake housing to be pivotable about an axis of rotation. In addition, the brake element is connected with a connecting part for the support so that the brake element in the case of vertical displacement of the brake housing experiences a rotation with respect to the support. The brake element can thereby be brought into engagement with the brake rail. Thus, use can be made of proven, essentially existing brake parts, which in turn can be economic and can promote customer acceptance.

The vertical guide has in this regard a guide length which on the one hand is sufficiently long in order to bring the brake element securely into engagement with the brake rail. On the other hand the vertical guide is so delimited that in the brake setting a braking force can be reliably introduced into the support. This delimitation is possibly achieved by an upper and lower vertical abutment, which abutments bound the guide length and which can transmit the braking force to the travelling body when required.

In further embodiments the brake element is provided with a centering device which holds the brake element in an operating position. It can thus be ensured that the elevator braking device can provide sufficient transit play for the brake rail and thus disturbance-free operation of the elevator installation is made possible. An air gap which is present in the operating position between brake element and brake rail so as to enable movement of the elevator cage or the counterweight is termed transit play. Coming into question as centering device are tension or compression springs which pull or press the braking element into a zero point position or operating position. Alternatively, the centering device can also be constructed as a snap device or detent device.

In further embodiments the elevator braking device generates in the second position a braking force which is suitable for braking the travelling body of the elevator installation in a travel direction and holding it at standstill. In addition, the elevator braking device can be reset by a release movement opposite to the travel direction. In that regard, the system is adapted in such a manner that a resetting force required for release of the elevator braking device or the clamping mechanism thereof is greater than the force of the force store. The brake housing, on resetting of the elevator braking device from the second position back to the first position, thus stresses the force store. At the same time the actuator can again grip and hold the brake housing in the first position. The actuator itself in that case does not need any further energy for resetting, since through the resetting movement the actuator is again geometrically placed in the first setting. Possibly, the actuator is constructed to be resiliently damping in that, for example, levers of the actuator are of resilient construction or in that coupling points, such as of the clamping electromagnet, are fastened by way of a resilient and damping support. Impacts such as occur on resetting of the system are thus damped.

In further embodiments the brake housing is mounted and retained in the support to be horizontally displaceable. The elevator braking device can thus be automatically orientated with respect to the brake rail when braking takes place. Extreme lateral loadings on guide elements of the travelling body are thus avoided.

In further embodiments the brake element has a center clamping region which is formed eccentrically or similarly to an eccentric with respect to the rotary bearing. In that regard, a radial spacing from the rotary bearing to the clamping region continuously increases over a rotational angle. Alternatively, the brake element comprises a control eccentric with a control cam. The control cam is formed eccentrically or similarly to an eccentric with respect to the rotary bearing so that a radial spacing from the rotary bearing to the control cam increases over a rotational angle. In that case, through rotation of the control cam and of the control eccentric a brake shoe is pressed against the brake rail. A good self-energization of the elevator braking device can thus be achieved and pull-in reliability is high. External actuating forces can be kept small.

In further embodiments the elevator braking device further comprises a brake plate. This brake plate is so arranged that the brake rail or the corresponding guide rail can be clamped between the brake element and the brake plate. The brake plate is in this regard possibly fastened in the brake housing by means of a brake spring. This enables simple setting of the elevator braking device to required loads and enables compensation for wear.

In further embodiments the actuator comprises a clamping electromagnet with an armature plate. The brake housing can thus be electromagnetically held in the first position. In the first setting the armature plate in that case bears against the clamping electromagnet and it is electromagnetically held by this. A force of the clamping electromagnet counteracts the force of the force store. If the clamping electromagnet is deactivated the force store urges the brake housing upwardly. On return movement of the brake housing from the first position to the second position the armature plate, even in the current-free state of the clamping electromagnet, is constrainedly brought into contact with the clamping electromagnet. Thus, use can be made of particularly advantageous elements, since the clamping electromagnet does not have to bridge over an air gap for resetting the elevator braking device.

Alternatively, a latch solution can also be selected, wherein the latch for resetting is, for example, constrainedly latched in place, but still not locked. Locking takes place, for example, only after switching-on of a control circuit, which confirms correct functioning of the elevator installation.

In further embodiments the actuator comprises an assisting weight or it is appropriately shaped so that an entrainer, preferably a blocking roller of the actuator, is kept in contact with the brake housing.

Alternatively, or additionally the actuator comprises an assisting spring which keeps the entrainer or the blocking roller of the actuator in contact with the brake housing. The blocking roller enables friction-free lateral displacement of the brake housing and the assisting weight or the assisting spring has the effect that on resetting of the elevator braking device the actuator, for example the clamping electromagnet, is set into its initial position. As a result, merely a coil current of the clamping electromagnet can be switched on and the actuator is directly fixed.

In further embodiments the actuator is settable. Thus, setting of the first position of the brake housing can be performed precisely. This is made possible, for example, in that the armature plate is fastened by means of a setting screw.

Overall, an elevator braking device of that kind is installed in or attached to an elevator installation with an elevator cage and advantageously directly to the same. The brake rail is directly a component of the guide rail and the elevator braking device clamps a web of the guide rail for the purpose of the holding and braking.

Possibly, the elevator cage is provided with two elevator braking devices and these elevator braking devices can act on two guide rails arranged on opposite sides of the elevator cage. These two elevator braking devices are advantageously coupled with a synchronization rod and the two elevator braking devices possibly each comprise a respective actuator. The reliability of the elevator braking devices can thus be increased, since in the case of failure of one of the actuators the remaining actuator synchronously actuates the two elevator braking devices by way of the synchronization rod. One-sided braking is thus prevented. A counterweight of the elevator installation can also be equipped with corresponding braking devices.

BRIEF DESCRIPTION OF THE DRAWINGS

The disclosure is explained in conjunction with the figures, in which.

In the figures, the same reference numerals are used throughout all figures for equivalent parts.

DETAILED DESCRIPTION

Figure 1:
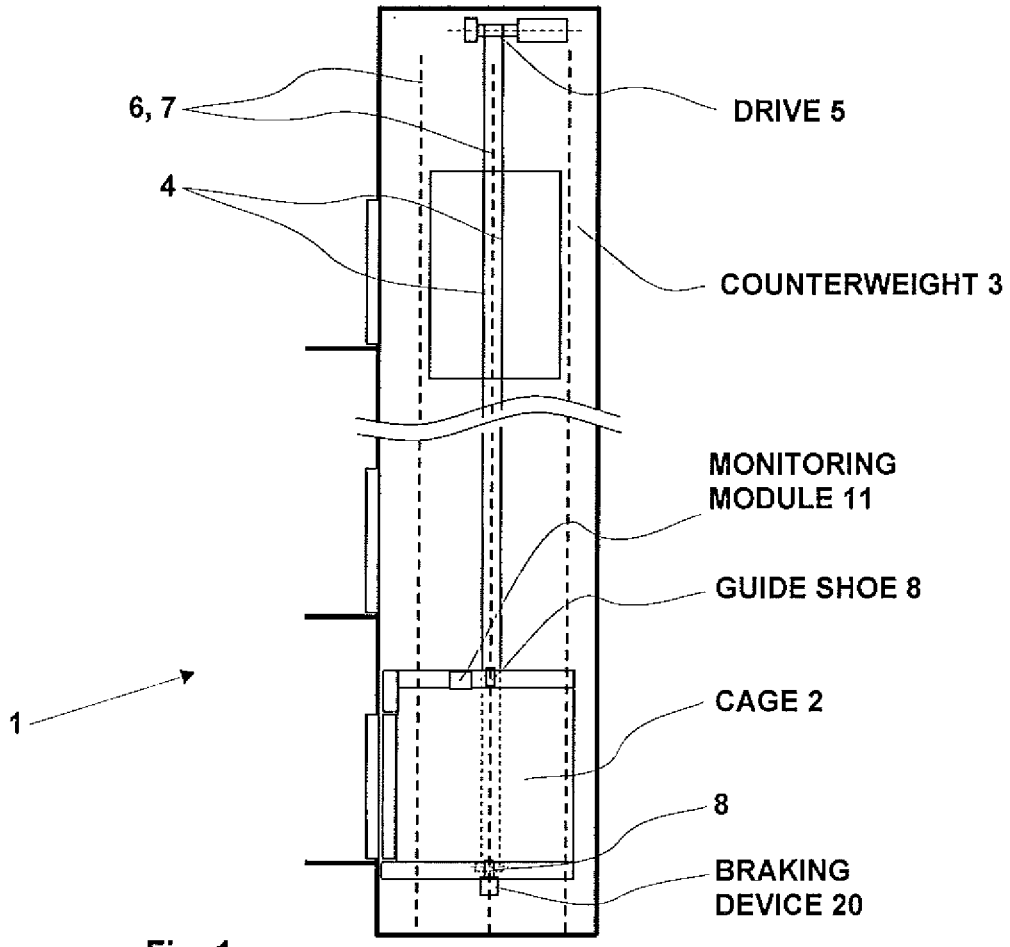
FIG. 1 shows a schematic view of an elevator installation in side view.

FIG. 1 shows an elevator installation 1 in an overall view. The elevator installation 1 is installed in a building and serves for transport of persons or goods within the building. The elevator installation includes an elevator cage 2 which can move upwardly and downwardly along guide rails 6. The elevator cage 2 is for that purpose provided with guide shoes 8 which guide the elevator cage, possibly as accurately as possible, along a predetermined travel path. The elevator cage 2 is accessible from the building by way of doors. A drive 5 serves for driving and holding the elevator cage 2. The drive 5 is arranged in, for example, the upper region of the building and the cage 2 hangs by support means 4, for example support cables or support belts, at the drive 5. The support means 4 are guided by way of the drive 5 onward to a counterweight 3. The counterweight balances a mass proportion of the elevator cage 2 so that the drive 5 primarily merely has to provide compensation for an imbalance weight between cage 2 and counterweight 3. In the example, the drive 5 is arranged in the upper region of the building. It could also be arranged at a different location in the building or in the region of the cage 2 or the counterweight 3.

The elevator cage 2 is equipped with a braking system, which is suitable for securing and/or retarding the elevator cage 2 in the case of an unexpected movement or in the case of excess speed. In the example, the braking system is arranged below the cage 2 and is activated electrically, for example by way of a monitoring module 11. A mechanical speed limiter, such as is usually employed, accordingly can be eliminated.

The construction can be particularly suitable for an elevator braking device which as a so-termed safety brake device prevents excess speed of the elevator cage or the counterweight in downward direction.

Figure 2:
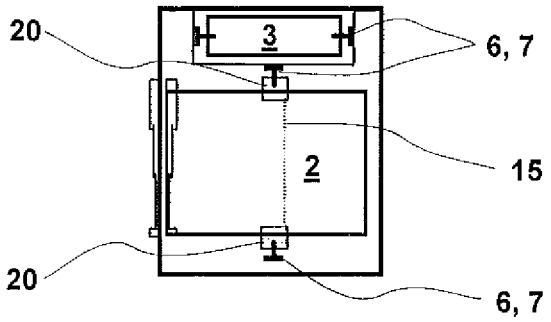
FIG. 2 shows a schematic view of the elevator installation in cross-section.

FIG. 2 shows the elevator installation of FIG. 1 in a schematic plan view. The braking system includes two elevator braking devices 20. The two elevator braking devices 20 are, in this example, coupled by means of a synchronization rod 15 so that the two elevator braking devices 20 are actuated together. An unintended one-sided braking can thus be avoided. The two elevator braking devices 20 are preferably of identical or mirror-symmetrical construction and they act when required on brake rails 7 arranged on both sides of the cage 2. The brake rails 7 are, in the example, identical to the guide rails 6. They can, in co-operation with the elevator braking devices 20, effect braking of the elevator cage 2.

It is also possible to dispense with the synchronization rod 15. However, electrical synchronization means, which can help ensure simultaneous triggering of elevator braking devices 20 arranged on both sides of the elevator cage, are then recommended.

Figure 3:
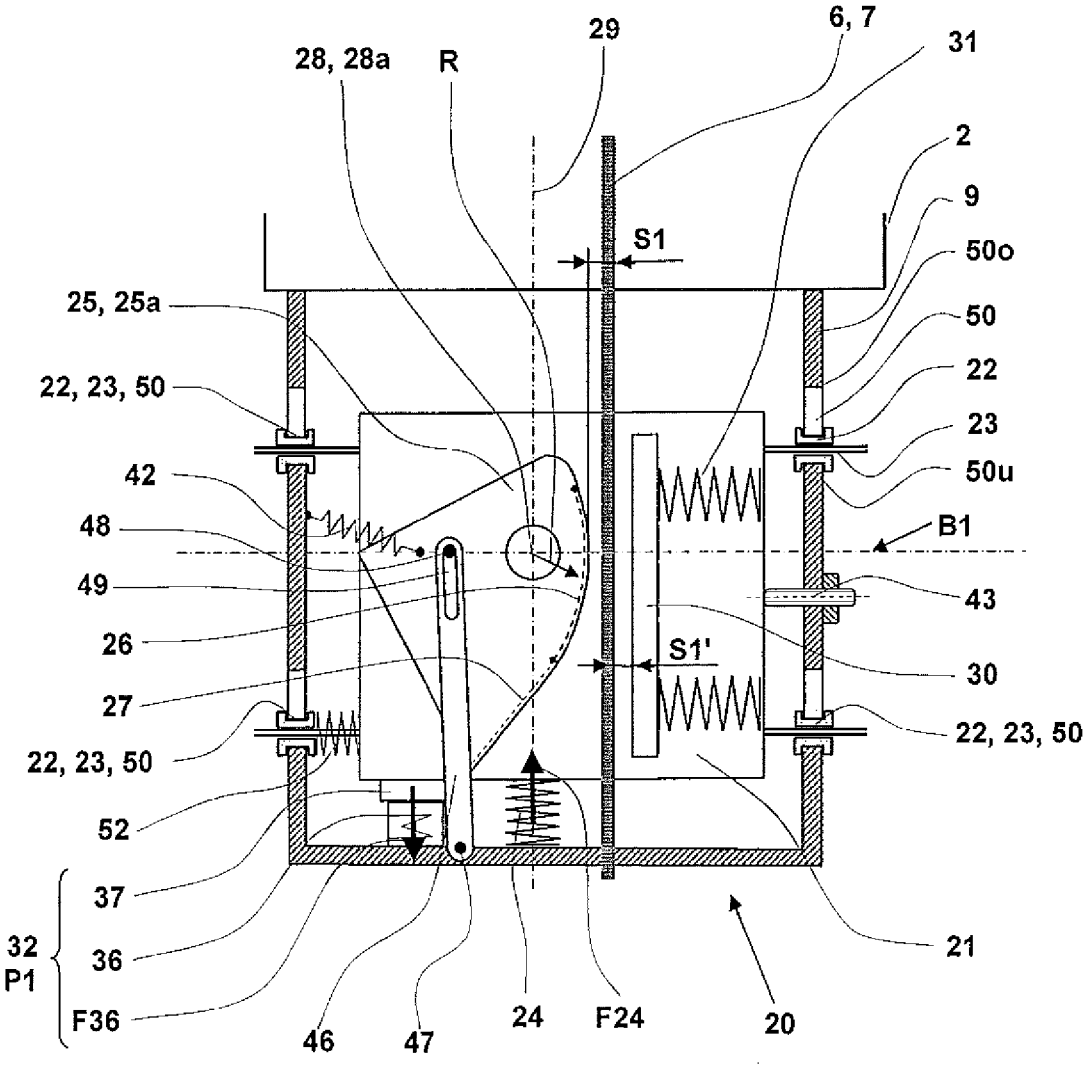
FIG. 3 shows a schematic view of an elevator braking device in a first, unactuated position.
Figure 4:
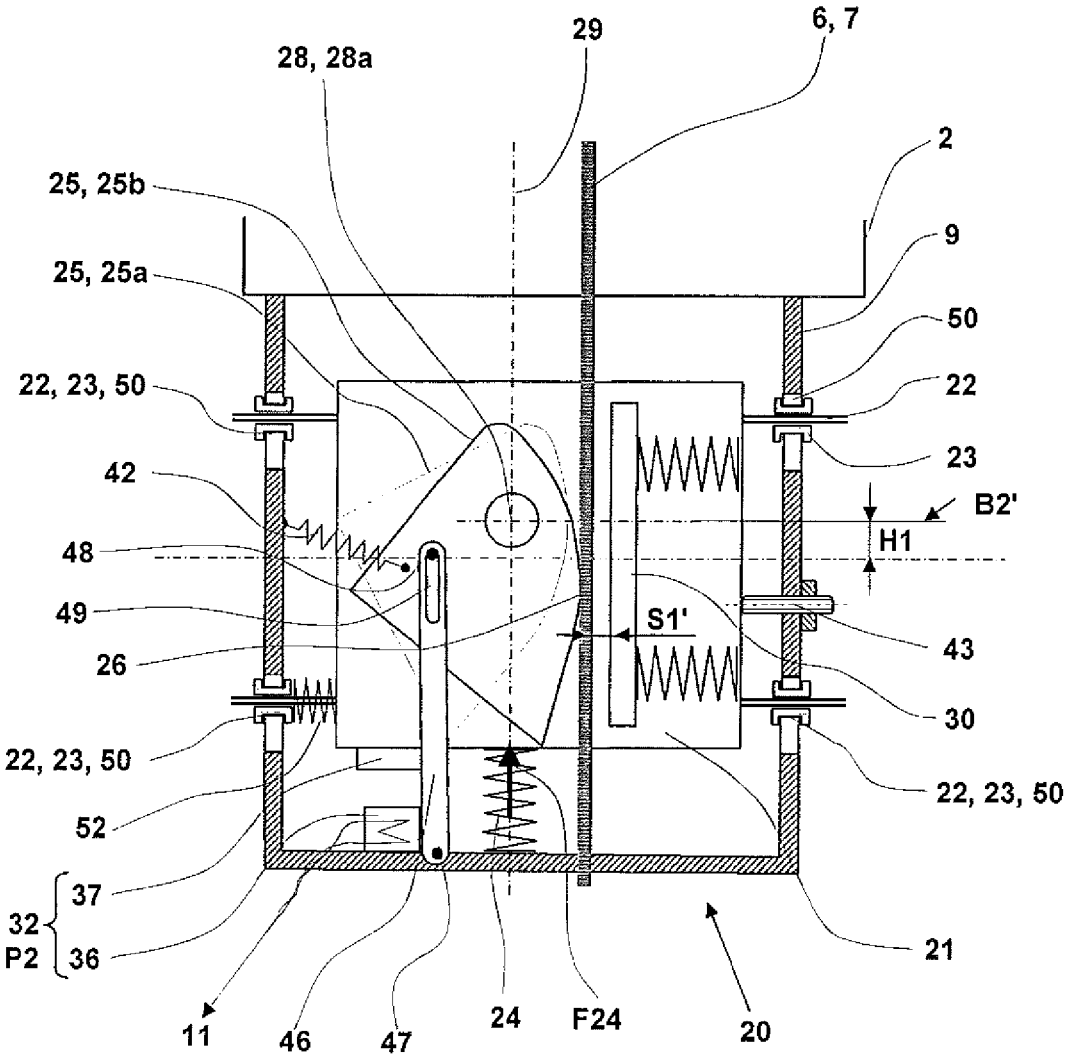
FIG. 4 shows the elevator braking device of FIG. 3 in a second, actuated position.

A first embodiment of an elevator braking device 20 is explained in schematic illustration in FIGS. 3 to 6. The figures illustrate the same elevator braking device 20 in different working positions. FIG. 3 shows the elevator braking device 20 in a first position B1. This position illustrated in FIG. 3 also corresponds with a normal position of the elevator braking device. In this position, the travelling body 2, 3 or the elevator cage 2 can be moved. The elevator braking device 20 does not brake.

A brake housing 21 is installed in a support 9. The support 9 is attached to the travelling body 2, 3, usually the elevator cage 2. Alternatively, the support 9 can also be a direct component of the elevator cage. The brake housing 21 in the example is fastened in the support 9 by way of slide connections 22, 23, 50 in such a manner that on the one hand it is displaceable in vertical direction within vertical guides 50, for example in slots. On the other hand, it is also displaceable in lateral direction by way of guide rods 22 and sliding guides 23. In a simple embodiment the guide rod 22 can also be arranged directly in the slot of the vertical guide 50. An adjusting spring 52 presses the brake housing 21 against an abutment 43, which is possibly settable. The adjusting spring 52 can be a compression spring, a tension spring or another force element. Instead of individual springs, a plurality of springs can also be used. It can be important that the adjusting force produced by the adjusting spring 52 is independent of possible movement states or acceleration states of the travelling body.

A force store 24 urges the brake housing 21 by a force F24 in upward direction. However, this force F24 counteracts an actuator 32. In the example, the actuator 32 is a clamping electromagnet 36. The clamping electromagnet 36 produces, in the switched-on state P1, a magnetic holding force F36 which is so dimensioned that it can hold the brake housing in the first position B1. Possibly, for that purpose an armature plate 37, which guarantees ideal adhesion conditions with respect to the brake housing 21, is arranged at the brake housing 21. The brake housing 21 can also itself form the armature plate 37.

Possibly, the size of the armature plate 37 is selected to be larger than the size of the clamping electromagnet 36. Thus, inaccuracies in production and assembly can be equalized. A brake element 25 is arranged in the brake housing 21. In the example, the brake element 25 is arranged to be pivotable about an axis 28*a* of rotation or about a corresponding rotary bearing 28. The brake element 25 is connected with the support 9 by way of a connecting part 46 and is at the same time resiliently located by a centering device 42, for example a tension device or a tension spring. A position of the brake element 25 is thus determined by the position of the brake housing 21 or a position of the axis 28*a* of rotation, a geometry of the connecting part 46 and the force action of the centering device 42. The connecting part 46 is connected with the support 9 by way of a bearing point 47 and is connected with the brake element by way of a fastening point 48. The connecting part 46 includes a freewheel in the form of a slot 49, the function of which is explained later.

The brake element 25 has a central clamping region 26, which is formed to be eccentric with respect to the axis 28*a* of rotation so that a radial spacing R from the axis 28*a* of rotation to the clamping region 26 increases over a rotational angle. A braking region 27 is connected with the clamping region 26 without transition. The clamping region 26 is formed in such a manner that in the case of pressing of the clamping region 26 against a guide rail 6 the brake element 25 is automatically entrained or further rotated. The clamping region 26 is, for example, knurled. In the illustrated normal position of the elevator braking device 20 the connecting part 46, centering device 42 and position of the brake element 25 are so matched to one another that a transit play S1 can be set between brake element and guide rail 6. The position of the brake element 25 in this non-braking arrangement is denoted in FIG. 3 by 25*a*. The brake housing 21 additionally includes a brake plate 30, which is constructed as a brake counter-lining. An intermediate space corresponding with the thickness of the guide rail 6 or a brake rail 7 plus twice the amount of the transit play S1 is present between brake element 25 and brake plate 30 in the non-braking arrangement according to 25*a*. The transit play S1 usually amounts to approximately 1.5 mm (millimeters) to 3.0 mm (millimeters).

If the monitoring module 11 of the elevator installation 1 now detects a fault in the elevator installation, which requires engagement of the elevator braking device 20, the monitoring module 11 deactivates the actuator 32 or interrupts a current feed to the clamping electromagnet 36. The monitoring module is in that case possibly so constructed that the current feed to the clamping electromagnet 36 is not only interrupted, but regulated in such a manner that the magnetic field rapidly decays. A rapid response of the elevator braking device can thereby be achieved. As a consequence of the dropping off of the magnetic field, the retaining force F36 of the clamping electromagnet 36 is eliminated and the force store 24 urges the brake housing 21 together with the axis 28*a* of rotation upwardly into a first intermediate position B2' as apparent in FIG. 4. This means that the brake housing or the axis 28*a* of rotation of the brake element 25 is displaced vertically, in a direction parallel to a direction of braking. This displacement is made possible by the vertical guide 50. In that case, the brake element is now restrained by the connecting part 46 at the fastening point 48, whereby a rotation of the brake element 25 about the axis 28*a* of rotation results. This takes place as long as the clamping region 26 of the brake element 26 is in contact with the guide rail 6 or pressed against the guide rail 6. This position of the brake element 25 is denoted in FIG. 4 by 25*b*. Insofar as the travelling body 2, 3 is in a downward movement or as soon as, for example, it slips downwardly, the brake element 25 is automatically rotated by the clamping region 26 further from the guide rail 6, whereby the brake housing 21 is laterally moved away until the transit gap S1' between brake plate 30 and guide rail 6 is eliminated and further until the braking region 27 of the brake element 25 is reached.

Figure 5:
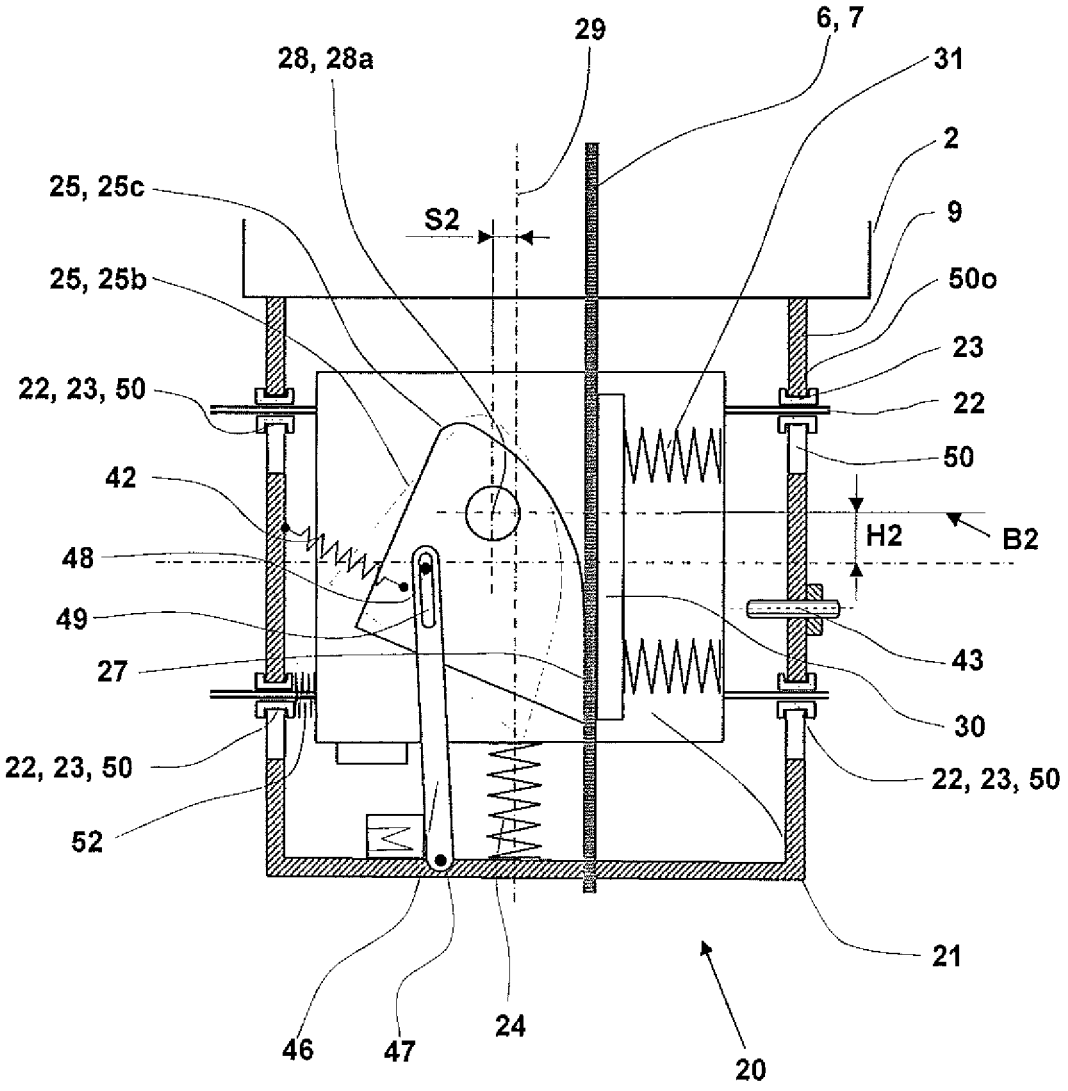
FIG. 5 shows the elevator braking device of FIG. 3 in a further second, braking position.

The brake housing 21 or the axis 28*a* of rotation of the brake element 25 has now reached a second position B2, which is illustrated in FIG. 5. The brake element has reached its braking position, which is denoted in FIG. 5 by 25*c*. The second position B2 in the support 9 is determined by the shape and size of the vertical guide 50. In this embodiment the vertical guide 50 is bounded by a lower vertical abutment 50*u* and an upper vertical abutment 50*o*. The braking region 27 produces, together with the brake plate 30, a requisite braking force in order to securely brake and hold the travelling body. The braking force is transmitted by way of the guide rod 22 and the boundary of the vertical guide 50 or, in the example, by way of the upper vertical abutment 50*o* to the support 9 and onward to the travelling body 2, 3. The fastening point 48 at the brake element 25 has similarly moved downwardly in the slot 49 of the connecting part 46. This means that when clamping between clamping region 26 and guide rail 6 and reaching of the boundary of the vertical guide 50 or of the corresponding vertical abutment have taken place, the connecting part 46 is relieved of load and transfers into freewheeling.

For the purpose of resetting the elevator installation or for relieving the elevator braking device 20 the travelling body 2, 3 is now raised. This usually takes place with the help of the drive 5 of the elevator installation 1 or, if this is defective, also by other aids or lifting apparatus.

Figure 6:
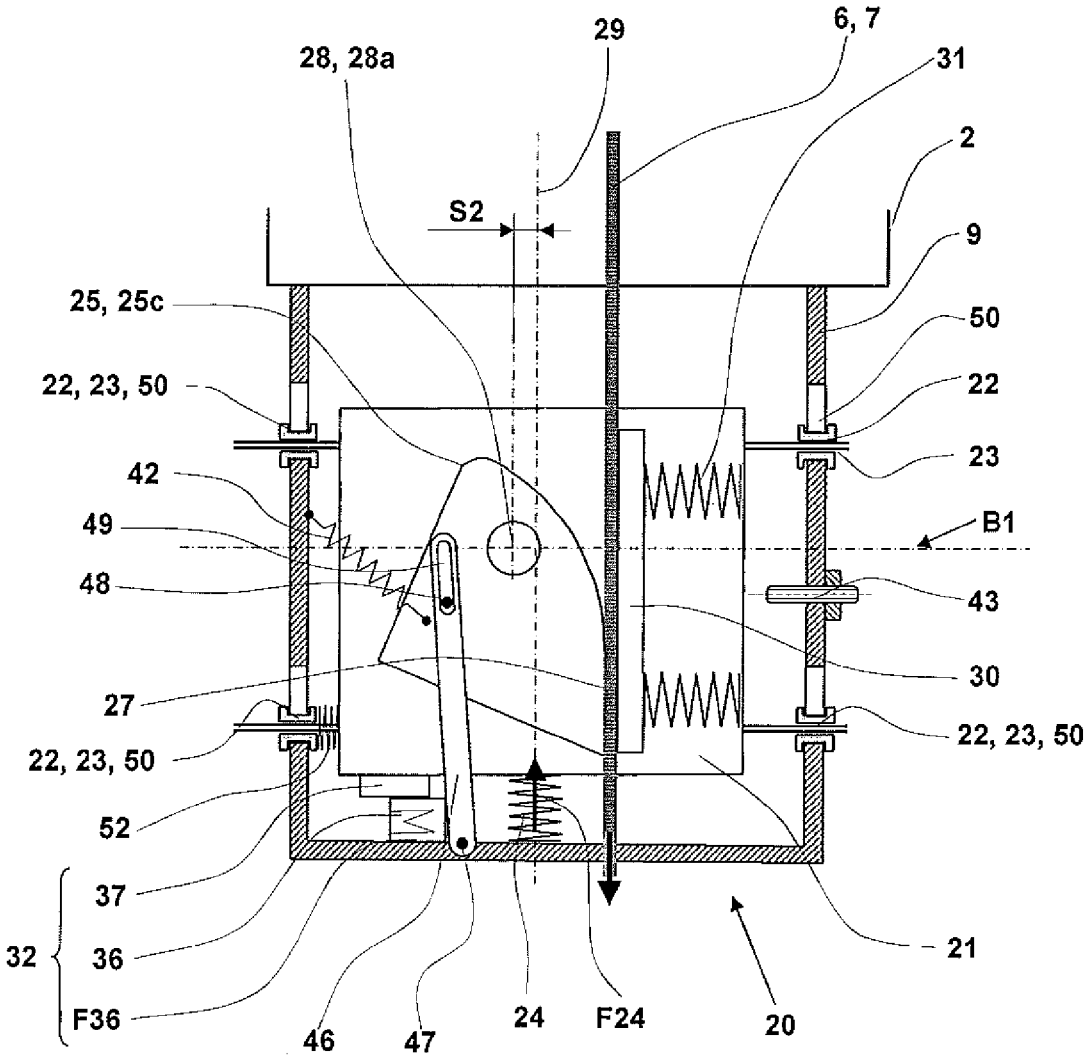
FIG. 6 shows the elevator braking device of FIG. 3 in a first reset position.

Since the brake element 25 together with the brake plate 30 is as before clamped to the guide rail 6, the support 9 can, as apparent in FIG. 6, be set into motion within the vertical guide 50. The brake housing 21 thus regains the original first position B1 and the armature plate 32 is guided up to the clamping electromagnet 36. Insofar as the monitoring module 11 imparts appropriate freedom, the magnetic field of the clamping electromagnet 36 can be switched on, whereby the brake housing 21 can again be held in this first position B1. On further movement of the travelling body in upward direction the brake element 25, which clamps as before, rotates back until the normal position illustrated in FIG. 3 is reached again. The contact area between armature plate 37 and clamping electromagnet 36 is in that case provided with, for example, a sliding layer which promotes lateral resetting of the brake housing 21. The form of the brake element 25 is by way of example. Other forms are possible. The forms are usually determined or optimized by tests.

Figure 7:
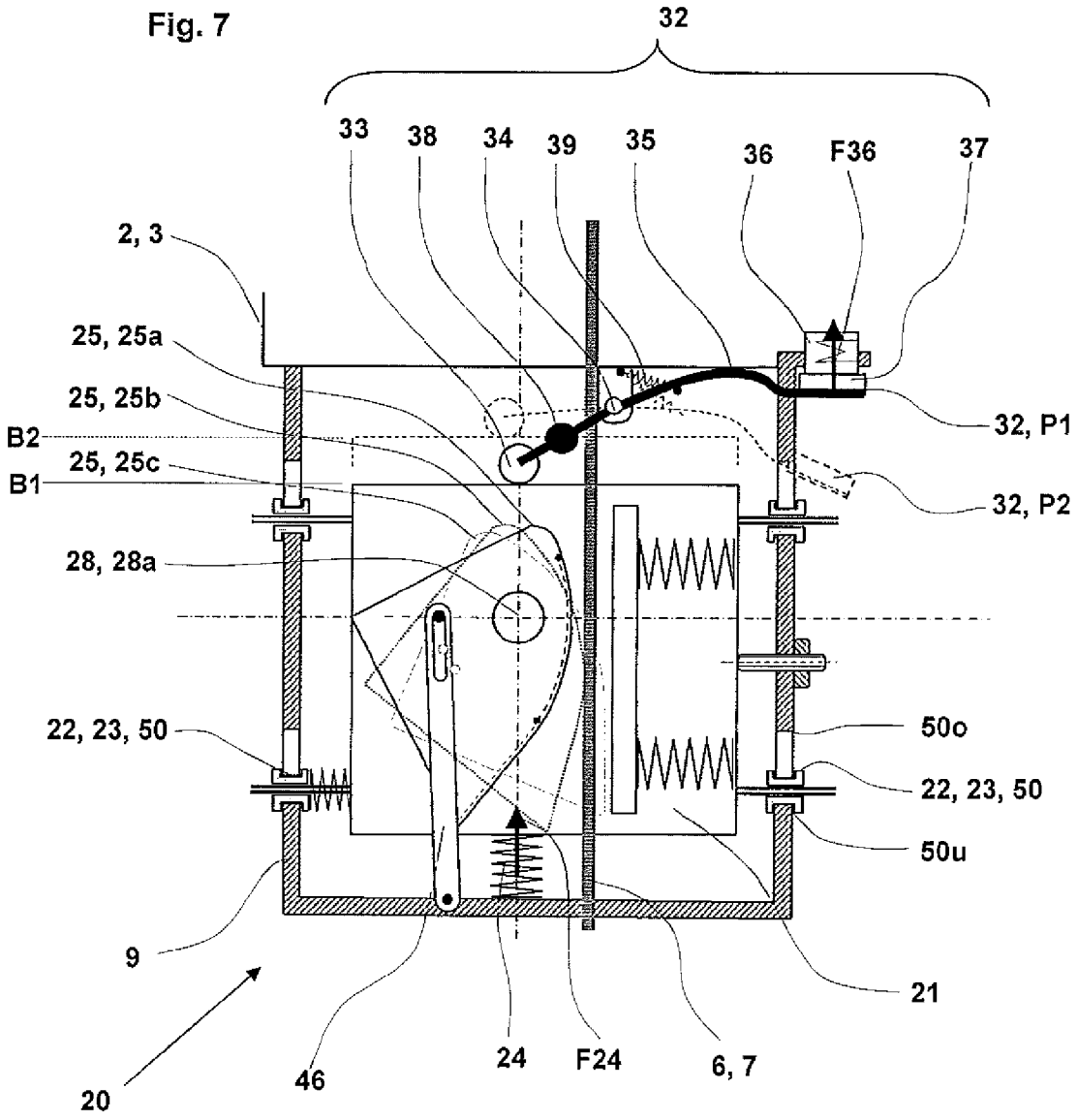
FIG. 7 shows an alternative embodiment of an actuator for the elevator braking device of FIG. 3.

An alternative embodiment of the elevator braking device 20 known from the preceding example is illustrated in FIG. 7. By contrast to the preceding embodiment the actuator 32 is constructed by means of a lever mechanism.

Instead of the direct electromagnetic restraint, the brake housing 21 and thus the axis 28*a* of rotation of the brake element 25 are held in the first position B1 by way of a blocking roller 33. The blocking roller 33 is arranged on a blocking lever 35 which is mounted at a fulcrum 34. The blocking 35 is now held by the clamping electromagnet 36 with affiliated armature plate 37 in the first position P1. On removal of the force F36 of the clamping electromagnet 36 the blocking roller 33 can deflect and the force store 24 can urge the brake housing 21, as explained in the preceding embodiment, together with the axis 28*a* of rotation upwardly into the second position B2', B2. The relaxation can also be carried out as described in the foregoing. In this regard, the blocking lever 35 together with the blocking roller 33 and the armature plate 37 is reset by, for example, an assisting weight 38 or an assisting spring 39 so that the armature plate 37 on reaching the first position B1 and the first setting P1 of the actuator bears against the clamping electromagnet 36.

A lateral displacement of the brake housing 21 can in that case take place in simple manner, since the blocking roller 33 produces virtually no lateral resistance to shifting. In addition, a required electromagnetic force of the clamping electromagnet 36 can be designed to be small, since the required force F36 of the clamping electromagnet 36 can be reduced by way of selection of the lever arrangement.

Numerous alternative variants of embodiment exist. Thus, for example, a horizontally arranged pivot bearing can be used instead of the vertical guide 50 or a counter-braking wedge, which produces an additional amplification, can be used instead of the brake plate 30.

Figure 8F:
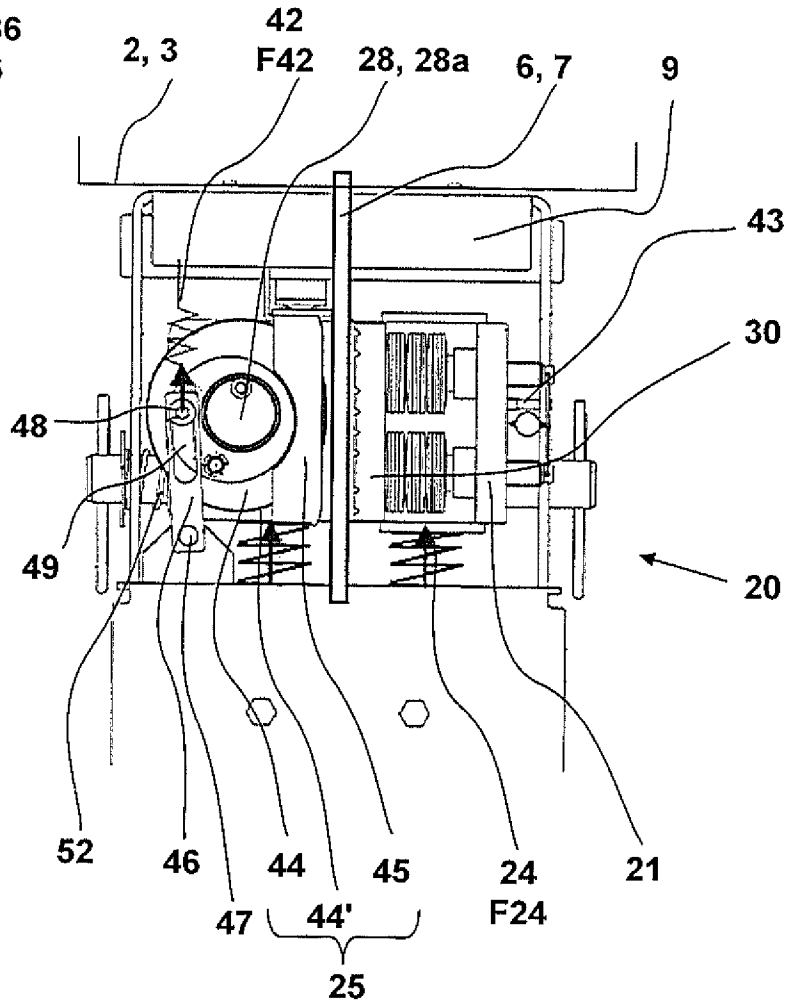
FIG. 8*f* shows a front view with respect to the elevator braking device of FIG. 8*s*.
Figure 8S:
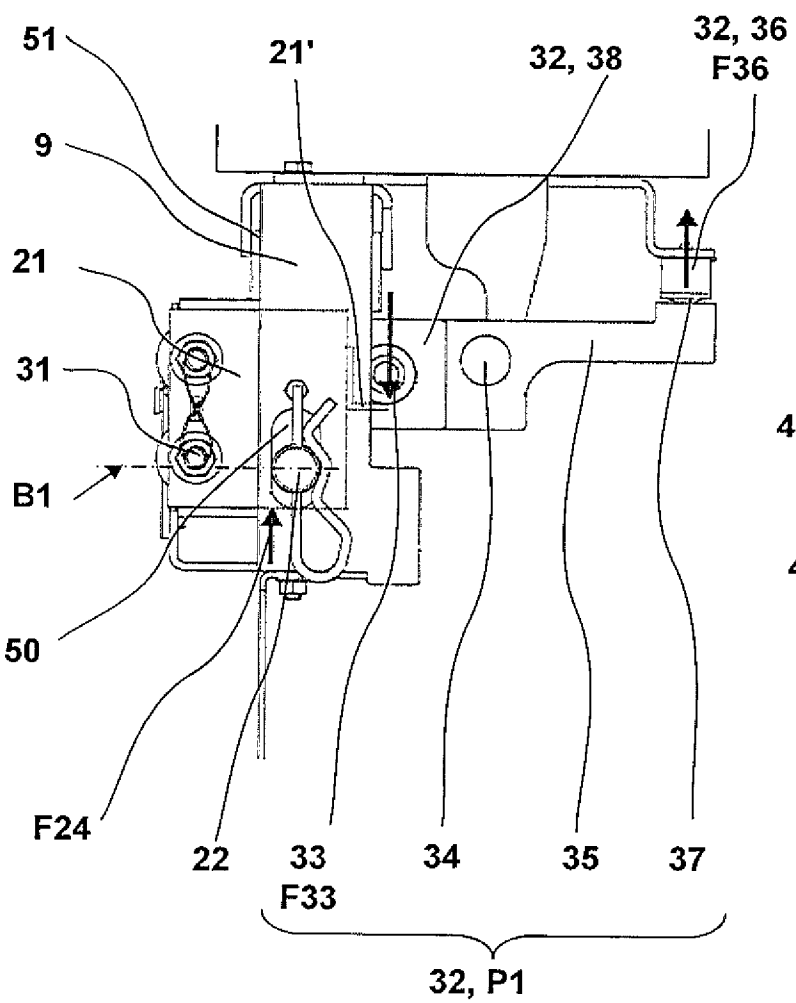
FIG. 8*s* shows a side view of a further embodiment of an elevator braking device in a first, unactuated position.
Figure 9F:
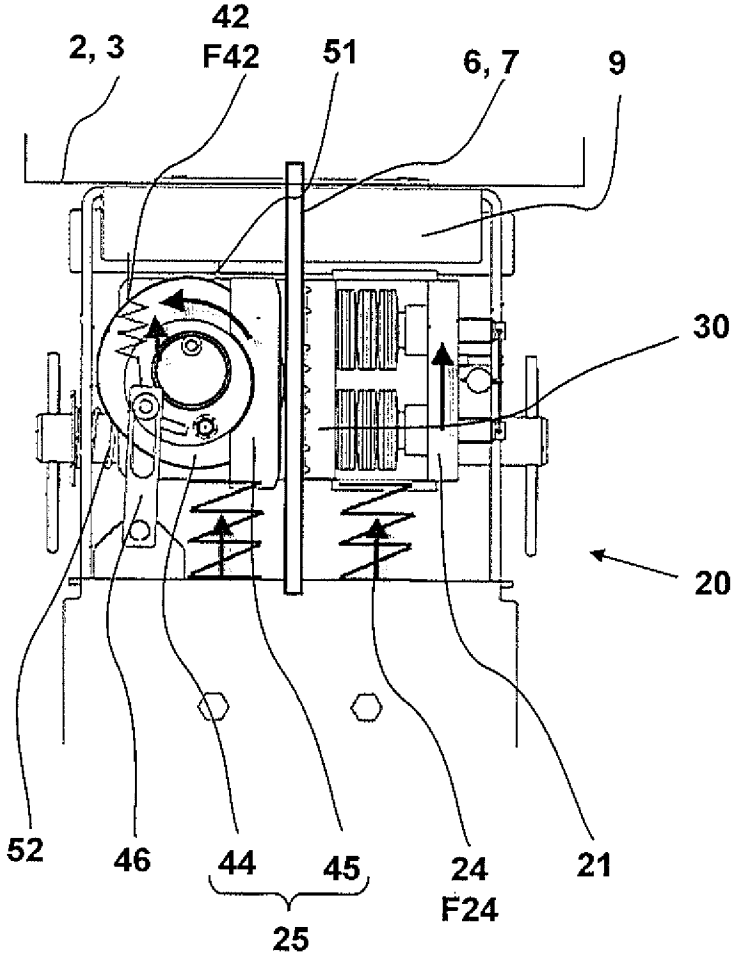
FIG. 9*f* shows a front view with respect to the elevator braking device of FIG. 9*s*.
Figure 9S:
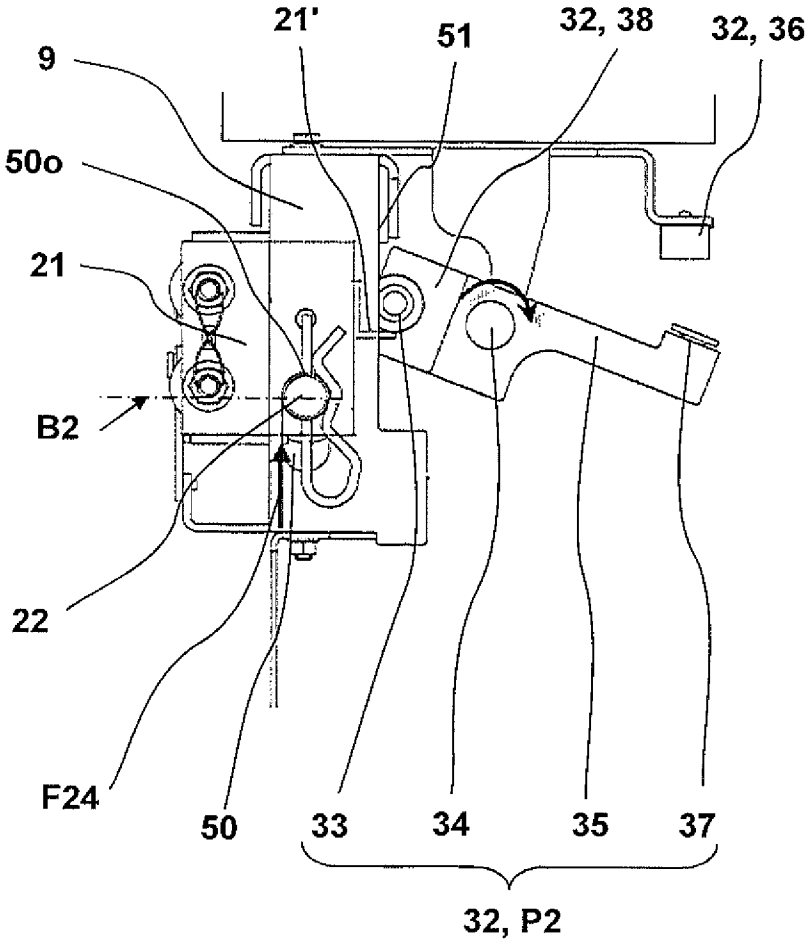
FIG. 9*s* shows a side view of the further embodiment of FIG. 8*s* in a second, actuated position

A further embodiment of an elevator braking device 20 is explained in FIGS. 8*s*, 8*f* and 9*s*, 9*f*. In this embodiment, use is made, by way of example, of a braking device such as is known in basic form from DE 2139056. FIGS. 8*s* and 8*f* illustrate the elevator braking device 20 in the first position B1, in which 8*s* shows a side view and 8*f* a view from the front. FIGS. 9*s* and 9*f* show the same elevator braking device in the second position B2. The first position B1 illustrated in FIGS. 8*s* and 8*f* again corresponds with the normal position of the elevator braking device 20. In this position the travelling body 2, 3 or the elevator cage 2 can be moved. The elevator braking device does not brake. The brake housing 21 is again installed in the support 9. The support 9 is attached to the travelling body 2, 3. Alternatively, the support 9 in this embodiment can also obviously be a direct component of the elevator cage or of the travelling body.

In the example, the brake housing 21 is fastened in the support 9 by way of the individual guide rod 22 in the vertical guide 50 in such a manner that it is displaceable in vertical direction within the vertical guides 50, here in the form of slots. In this example as well the vertical guide 50 is delimited by vertical abutments 50*u*, 50*o*. Disposed at the second end of the brake housing 21 is a tipping abutment 51 which is constructed in order to introduce, in co-operation with the guide rod 22 and the corresponding vertical abutment of the vertical guide 50, requisite braking forces from the brake housing 21 into the support 9. At the same time, the brake housing 21 is also mounted to be displaceable in lateral direction by way of the guide rods 22. In this example as well, the resetting spring 52 urges the brake housing 21 against the settable abutment 43. This settable abutment 43 is, for example, an abutment screw, which is screwed into the support 9 and which thus determines a lateral position of the brake housing 21 in the support 9.

In this embodiment also the force store 24 urges the brake housing 21 by a force F24 in upward direction. In this example two compression springs are used. The number of springs used is in this regard of secondary importance. However, this force F24 opposes the actuator 32. The actuator 32 is again a clamping electromagnet 36. In switched-on state P1 the clamping electromagnet 36 generates a magnetic retaining force F36 which is so dimensioned that it can hold the brake housing 21 in the first position B1 by way of a brake housing abutment 21'. In this example the clamping electromagnet 36 acts on the brake housing abutment 21' by way of the blocking lever 35 and the blocking roller 33 arranged on the blocking lever. The blocking lever 35 acts by way of a lever translation, which is determined by the fulcrum 34 of the blocking lever 35.

The brake element 25 is again arranged in the brake housing 21. The brake element 25 includes, in this embodiment, a control eccentric 44 and a brake shoe 45. The control eccentric 44 is mounted to be rotatable about the axis 28*a* of rotation or about the corresponding rotary bearing 28. The control eccentric 44 is connected with the support 9 by way of the connecting part 46 and it is at the same time resiliently fixed by the centering device 42. A position of the control eccentric 44 is thus determined by the position of the brake housing 21 or a position of the axis 28*a* of rotation, a geometry of the connecting part 46 and the force action of the centering device 42. The connecting part 46 is connected with the support 9 by way of the bearing point 47 and it is connected with the brake element 25 or the control eccentric 44 by way of the fastening point 48. The connecting part 46 includes a freewheel in the form of a slot 49, the function of which was already explained in principle in the preceding example.

The control eccentric 44 comprises a control cam 44' which is formed with respect to the axis 28*a* of rotation so that a radial spacing R from the axis 28*a* of rotation to the control 44' increases over a rotational angle. For actuation of the elevator braking device, as apparent in FIGS. 9*s* and 9*f*, the clamping electromagnet 36 is deactivated. The monitoring module 11 for that purpose, for example, interrupts a current feed to the clamping electromagnet 36'. The retaining force F36 of the clamping electromagnet 36 thereby drops away and the force store 24 urges the brake housing together with the axis 28*a* of rotation upwardly, ultimately into the second position B2. This means that the brake housing or the axis 28*a* of rotation of the brake element 25 together with control eccentric 44, control cam 44' and brake shoe 45 is vertically displaced in the support 9. This displacement is made possible by the vertical guide 50. In that case, the control eccentric 44 is now restrained by the connecting part 46 at the fastening point 48, whereby a rotation of the control eccentric 44 about the axis 28*a* of rotation results. This takes place as long as the control cam 44' of the control eccentric 44 is in contact with the guide rail 6 or pressed against the guide rail 6. Insofar as the travelling body 2, 3 is disposed in downward movement or as soon as, for example, it slips downwardly the control eccentric 44 is automatically further rotated, whereby the brake housing 21 is laterally pushed away until the transit play between brake plate 30 and guide rail 6 is eliminated. In addition, through rotation of the control eccentric 44 the brake shoe 45 is brought into contact with the guide rail 6 or pressed thereagainst. The elevator braking device 20 has thus achieved the brake setting. The entire functionality in the slot 49 and force transmission arises analogously as explained in connection with the preceding embodiments.

For the purpose of resetting the elevator installation or for relieving the elevator braking device 20 the travelling body 2, 3 is now again lifted. Since the brake element 25 or the control eccentric 44 together with the brake shoe 45 and the brake plate 30 is clamped, as before, on the guide rail 6, the support 9 can be set into motion within the vertical guide 50. The brake housing 21 thus again attains the original first position B1 and the blocking lever 35 or the armature plate 37 arranged if need be on the blocking lever is brought up to the clamping electromagnet 36. Insofar as the monitoring module 11 imparts corresponding freedom, the magnetic field of the clamping electromagnet 36 can be switched on, whereby the brake housing 21 can again be held in this first position B1. On further movement of the travelling body in upward direction the brake element 25, which is clamping as before, rotates back until the normal position illustrated in FIGS. 8*s* and 8*f* is reached again. In this regard it is to be mentioned that the vertical guide 50 additionally makes it possible for the travelling body 2, 3 during resetting to be able to be set in motion regardless of the clamping resistance of the elevator braking device and on reaching the first end of the vertical guide 50 for a movement energy of the travelling body 2, 3 to assist resetting of the elevator braking device.

The illustrated arrangements can be varied. The brakes can be attached above or below the cage 2. In addition, a plurality of brake pairs can be used at a cage 2. The braking device can also be used in an elevator installation with several cages, wherein then each of the cages has at least one braking device of that kind. The braking device can, if required, also be attached to the counterweight 3 or it can be attached to a self-propelling cage.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator braking device for braking a traveling body movable in a vertical direction in an elevator installation, comprising:

a brake housing being arranged on the traveling body, the brake housing being mounted in a vertical guide of the traveling body and displaceable in the vertical direction in the vertical guide between a first position and a second position;

a force store that exerts a force on the brake housing and urges the brake housing toward the second position; and a switchable actuator with first and second settings, the switchable actuator in the first setting keeping the brake housing in the first position and in the second setting causing a braking force produced by the elevator braking device to be transmitted by the brake housing to the traveling body by contact of the brake housing with an abutment of the vertical guide; and wherein the vertical guide is positioned outside of the break housing containing the breaking device.

2. The elevator braking device according to claim 1 wherein the switchable actuator in the second setting frees the brake housing such that the brake housing is moved toward the second position by the force store and a brake element of the elevator braking device is brought into contact with a brake rail.

3. The elevator braking device according to claim 1 wherein the first position of the brake housing is below the second position relative to vertical travel direction.

4. The elevator braking device according to claim 1 further comprising a support, the support being attached to the traveling body and including the vertical guide.

5. The elevator braking device according to claim 4 wherein the force store includes a compression spring for moving the brake housing toward the second position.

6. The elevator braking device according to claim 5 wherein the compression spring is arranged between the support and the brake housing.

7. The elevator braking device according to claim 4 further comprising a brake element mounted in the brake housing and pivotable about an axis of rotation, the brake element being connected with a connecting part of the support such that the brake element is rotated when displacement of the brake housing occurs relative to the support and the brake element engages a brake rail.

8. The elevator braking device according to claim 7 wherein the brake element includes a center clamping region, the center clamping region being eccentric relative to the axis of rotation such that a radial spacing from the axis of rotation to the center clamping region increases over a rotational angle.

9. The elevator braking device according to claim 7 wherein the brake element includes a control eccentric with a control cam, the control eccentric being eccentric relative to the axis of rotation such that a radial spacing from the axis of rotation to the control cam increases over a rotational angle, wherein through rotation of the control eccentric a brake shoe is pressed against the brake rail.

10. The elevator braking device according to claim 1 further comprising a brake element, the brake element including a centering device that keeps the brake element in a readiness setting.

11. The elevator braking device according to claim 1 generating a stopping and holding force for the traveling body when the brake housing is in the second position, the elevator braking device being resettable by a release movement opposite a travel direction of the traveling body, a resetting force for the release movement being greater than the force exerted by the force store.

12. The elevator braking device according to claim 1 further comprising a brake plate, wherein a brake rail or a guide rail can be clamped between a brake element and the brake plate, the brake plate being fastened to the brake housing.

13. The elevator braking device according to claim 12 wherein the brake plate is fastened to the brake housing by a brake spring.

14. The elevator braking device according to claim 1 wherein the switchable actuator includes a clamping electromagnet and an armature plate, wherein the clamping electromagnet can electromagnetically keep the brake housing in the first position, wherein when the brake housing is in the first position the armature plate is electromagnetically held by the clamping electromagnet.

15. The elevator braking device according to claim 14 wherein the switchable actuator includes an assisting weight that keeps a blocking roller in contact with the brake housing.

16. The elevator braking device according to claim 14 wherein the switchable actuator includes an assisting spring.

17. The elevator braking device according to claim 1 wherein the brake housing is displaceable in the vertical guide between the first position in contact with a lower abutment of the vertical guide and the second position in contact with the abutment being an upper abutment of the vertical guide.

18. An elevator installation, comprising:

an elevator cage, a guide rail, the guide rail comprising a brake rail, the elevator cage being movable in a vertical direction along the guide rail; and an elevator braking device for braking the elevator cage, comprising, a brake housing being arranged on the elevator cage, the brake housing being mounted in a vertical guide of the elevator cage and displaceable in the vertical direction in the vertical guide between a first position and a second position, a force store that urges the brake housing toward the second position, and a switchable actuator with first and second settings, the switchable actuator in the first setting keeping the brake housing in the first position and in the second setting causing a braking force produced by the elevator braking device to be transmitted by the brake housing to the elevator cage by contact of the brake housing with an abutment of the vertical guide; and wherein the vertical guide is positioned outside of the break housing containing the breaking device.

19. The elevator installation according to claim 18 the brake housing is displaceable in the vertical guide between the first position in contact with a lower abutment of the vertical guide and the second position in contact with the abutment being an upper abutment of the vertical guide.

* * * * *